United States Patent [19]

Yoshida

[11] Patent Number: 4,917,067

[45] Date of Patent: Apr. 17, 1990

[54] SYSTEM FOR CONTROLLING AIR-FUEL RATIO OF COMBUSTIBLE MIXTURE FED TO INTERNAL COMBUSTION ENGINE

[75] Inventor: Hideji Yoshida, Hashima, Japan

[73] Assignee: NGK Spark Plug Co., Ltd., Nagoya, Japan

[21] Appl. No.: 229,466

[22] Filed: Aug. 8, 1988

[30] Foreign Application Priority Data

Nov. 5, 1987 [JP] Japan ..... 62-279853

[51] Int. Cl.[4] ..... F02D 41/14

[52] U.S. Cl. ..... 123/488; 123/489

[58] Field of Search ..... 123/440, 488, 489, 494

[56] References Cited

U.S. PATENT DOCUMENTS

| | | | |
|---|---|---|---|
| 4,019,474 | 4/1977 | Nishimiya et al. | 123/440 |
| 4,116,170 | 9/1978 | Anzai | 123/440 |
| 4,337,745 | 7/1982 | Pomerantz | 123/440 |

FOREIGN PATENT DOCUMENTS 61-10762 1/1986 Japan .

*Primary Examiner*—Tony M. Argenbright

*Attorney, Agent, or Firm*—Foley & Lardner, Schwartz, Jeffery, Schwaab, Mack, Blumenthal & Evans

[57] ABSTRACT

There is disclosed a system for controlling air-fuel ratio of a combustion mixture fed to an internal combustion engine. The system comprises an oxygen sensor disposed in an exhaust system of the engine, the oxygen sensor exhibiting a sudden characteristic change when exposed to an exhaust gas produced by a combustible mixture of stoichiometic air-fuel ratio, the oxygen sensor issuing a signal representative of the oxygen concentration in the exhaust gas; first means for substantially linearizing the signal to produce a semi-linearized signal; and second means for controlling the amount of fuel fed to the engine in accordance with the semi-linearized signal.

9 Claims, 6 Drawing Sheets

OUTPUT VOLTAGE (V)
1.0
0.5
00
AIR/FUEL RATIO
17
16
15
14
13
12
are
are
g 7
g 6
ELAPSED TIME

AIR/FUEL RATIO
17
16
15
14
13
12
ELAPSED TIME

OUTPUT
1.0
0.5
0
g 4
g 3
g 5
g 3
g 4
14.4
14.5
14.6
14.7
14.8
AIR/FUEL RATIO

SYSTEM FOR CONTROLLING AIR-FUEL RATIO OF COMBUSTIBLE MIXTURE FED TO INTERNAL COMBUSTION ENGINE

BACKGROUND OF THE INVENTION

1. Field of the Invention

The present invention relates in general to an exhaust emission control system of an internal combustion engine, and more particularly, to a control system for controlling air-fuel ratio of a combustible mixture fed to an internal combustion engine.

2. Description of the Prior Art

Hitherto, for controlling the air-fuel ratio of a combustible mixture fed to an internal combustion engine, a so-called "jump back control system" has been widely employed in which a non-linear output signal of an oxygen sensor, which undergoes a sudden change in its output at the stoichiometric air-fuel ratio of the combustible mixture, is used with no modification thereof for controlling the air-fuel ratio. This will be understood from the performance curve "gl" (the curve illustrated by a dot-dash line) of FIG. 2, which is the non-linear output signal issued from the oxygen sensor. In the jump back control system, the output signal from the oxygen sensor is converted into a binary signal, and the fuel injection time is controlled in accordance with an instruction signal, consisting of a proportional part and an integral part, which is based on the binary signal. Japanese Patent First Provisional Publication No. 61-10762 shows one of the conventional control systems of the above-mentioned type.

However, due to its inherency in construction, the above-mentioned type control system has an occasion wherein a control error at the normal operation mode of the engine becomes considerable due to both the sudden change of the output of the oxygen sensor and the inevitable response delay of the air-fuel mixture injecting timing with respect to the time when the exhaust gas is detected by the oxygen sensor. In fact, as is seen from FIG. 8, a considerable response delay appears in the exhaust system of an internal combustion engine. FIG. 6B is a graph which depicts an air-fuel ratio under a condition wherein the frequency of the air-fuel ratio control system is 1 Hz and the engine runs at a speed of 3000 rpm with no load applied thereto. As is seen from this graph, a control error in the range of the air-fuel ratio from 0.6 to 0.7 is produced. This error causes lowering in the purifying efficiency of a three-way catalytic converter installed in the exhaust system. In order to eliminate this drawback, a larger amount of catalysts is usually necessary. However, this measure causes increase in production cost of the converter.

SUMMARY OF THE INVENTION

It is therefore an object of the present invention to provide an improved system for controlling air-fuel ratio of a combustible mixture fed to an internal combustion engine, which is free of the above-mentioned drawbacks.

According to the present invention, there is provided an air-fuel ratio control system which is characterized in that the control error of the air-fuel ratio at the normal operation mode of the engine is considerably reduced.

According to the present invention, there is provided a system for controlling air-fuel ratio of a combustion mixture fed to an internal combustion engine. The system comprises an oxygen sensor disposed in an exhaust system of the engine, the oxygen sensor exhibiting a sudden characteristic change when exposed to an exhaust gas produced by a combustible mixture of stoichiometic air-fuel ratio, the oxygen sensor issuing a signal representative of the oxygen concentration in the exhaust gas; first means for linearizing the signal to produce a semi-linearized signal; and second means for controlling the amount of fuel fed to the engine in accordance with the semi-linearized signal.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the present invention will be described in detail with reference to the accompanying drawings.

Figure 1:
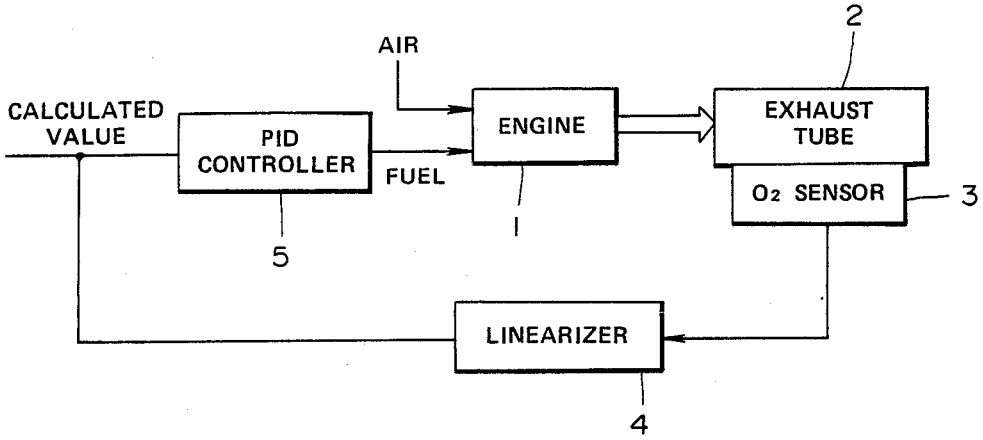
FIG. 1 is a block diagram of a control system of a first embodiment according to the present invention.

Referring to FIG. 1, there is shown a block diagram of an air-fuel ratio control system of a first embodiment of the present invention.

As is seen from the drawing, the oxygen concentration in the exhaust gas issued from an internal combustion engine 1 is measured by an oxygen sensor 3 which is mounted in an exhaust tube 2. The oxygen sensor 3 is of zirconia type equipped with a heater. An output voltage signal "Vs" produced by the oxygen sensor 3 shows such a non-linear characteristic as shown by the "dot-dash line" curve "gl" of FIG. 2. That is, the output voltage signal "Vs" shows about 0.5 V at the stoichiometric ratio ($\lambda=1$) and shows a sudden voltage change before and behind the stoichiometic ratio. The output voltage signal "Vs" produced by the oxygen sensor 3 is applied to a PID controller 5 (viz., proportional, integral and differential action controller) through a linearizer 4. The PID controller 5 determines the fuel amount "Q" which is to be practically injected into the engine. That is, the PID controller 5 determines the practically injected fuel amount "Q" by correcting, with an aid of a signal from the linearizer 4, the value of the injected fuel amount which has been calculated by a known electronic control device (not shown), based on the amount of air introduced into the engine. In the disclosed embodiment, the PID controller 5 carries out both a proportional action and an integral action.

The linearizer 4 functions to generally linearize the output voltage signal "Vs" produced by the oxygen sensor 3.

Figure 2:
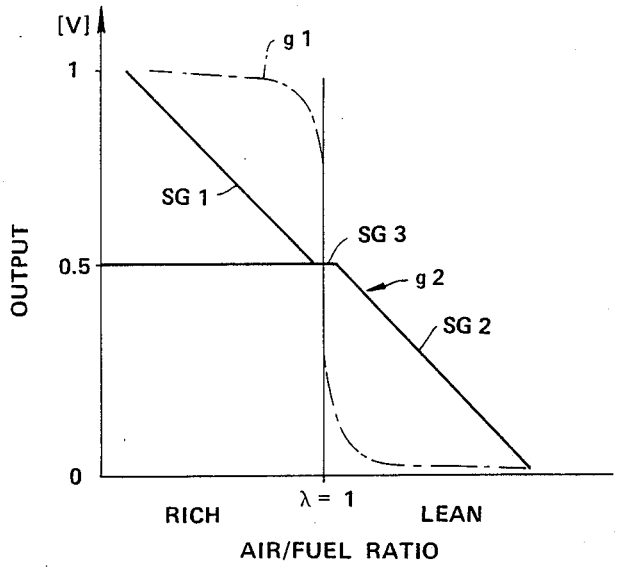
FIG. 2 is a graph showing an output signal issued from an oxygen sensor and a signal issued from a linearizer.
Figure 3:
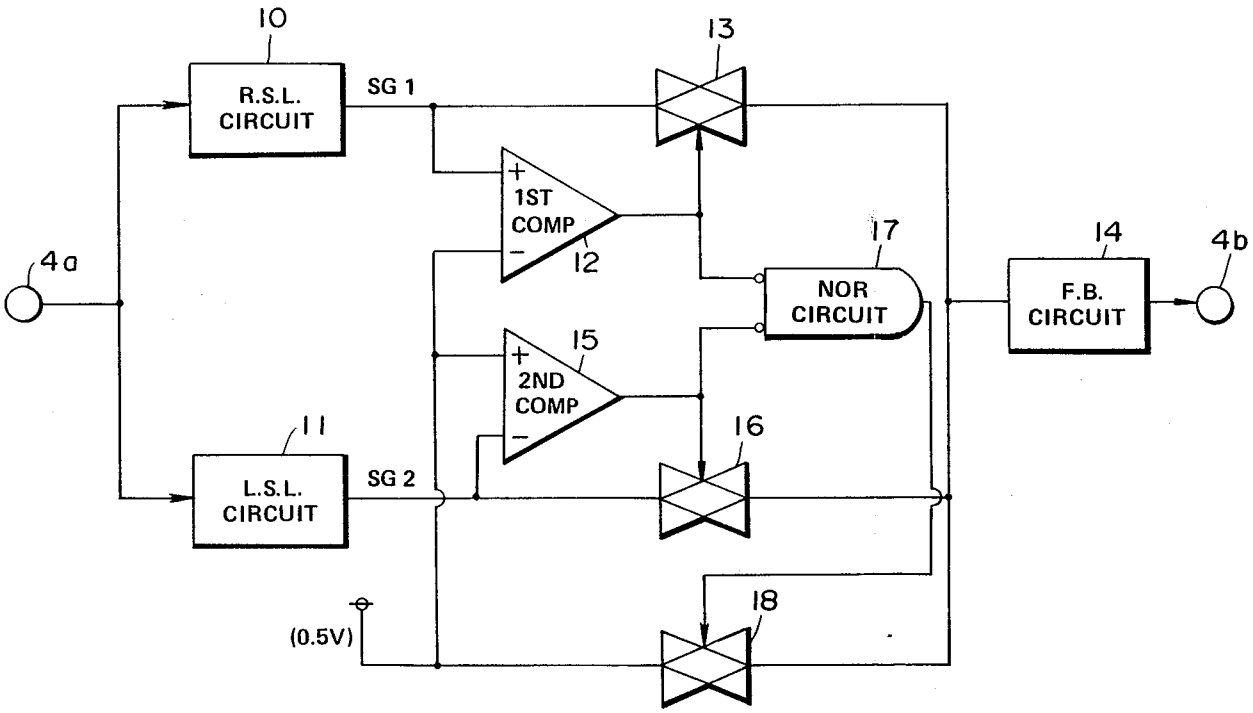
FIG. 3 is a block diagram of the linearizer.

As is shown in FIG. 3, the linearizer 4 has an input terminal 4*a* into which the output voltage signal "Vs" of the oxygen sensor 3 is fed, and an output terminal 4*b* from which an instruction signal is fed to the PID controller 5. The linearizer 4 comprises a rich signal linearizing circuit 10 which, by comparing a rich voltage signal higher than 0.5 V with a predetermined reference value, increases or decreases the rich voltage signal to produce a linear signal SGl (see FIG. 2), and a lean signal linearizing circuit 11 which, by comparing a lean voltage signal lower than 0.5 V with a predetermined reference value, increases or decreases the lean voltage signal to produce a linear signal SG2. A comparator 12 functions so that when the linear signal SGl is not lower than 0.5 V, a first analog switch 13 becomes ON thereby to feed a filter buffer circuit 14 with the linear signal SGl which is not lower than 0.5 V. Similar to this, another comparator 15 functions so that when the linear signal SG2 is lower than 0.5 V, a second analog switch 16 becomes ON thereby to feed the filter buffer circuit 14 with the linear signal SG2 which is lower than 0.5 V. A NOR circuit 17 which receives the outputs from the comparators 12 and 15 functions so that when the linear signal SGl is lower than 0.5 V and the linear signal SG2 is not lower than 0.5 V, a third analog switch 18 becomes ON thereby to feed the filter buffer circuit 14 with a predetermined value of 0.5 V. Accordingly, the output voltage signal "Vs" of the oxygen sensor 3 fed to the linearizer 4 is reformed to have such a substantially linearized performance curve "g2" as shown in FIG. 2 which has a non-sensible zone SG3 at the predetermined value of 0.5 dV.

Figure 4:
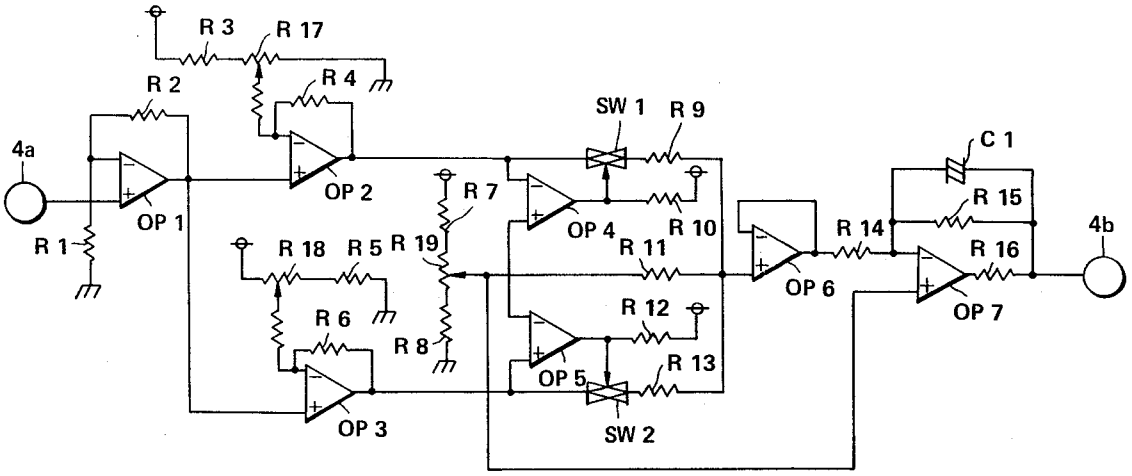
FIG. 4 is a circuit of the linearizer.

FIG. 4 shows concretely the circuit of the linearizer 4, which comprises seven operation amplifiers OP1 to OP7, sixteen fixed resistors R1 to R16, three variable resistors R17 to R19, two analog switches SW1 and SW2 and an electrolytic capacitor C1 which are combined in the illustrated manner.

In the following, the reason of providing the semi-linearized performance curve with the non-sensible zone SG3 will be described with reference to the graph of FIG. 5 which shows, by solid curves, outputs of a zirconia type oxygen sensor with respect to the air-fuel ratio of a combustible mixture fed to an internal combustion engine.

Generally, when the air-fuel ratio control is carried out with a higher frequency, the zirconia type oxygen sensor shows such a gentle response as depicted by the curve "g3" of the graph. Thus, it is difficult to completely linearize the output voltage signal Vs of the oxygen sensor throughout every operation mode of the engine wherein the control frequency is varied frequently.

In the invention, the performance curve prepared by the linearizer 4 has the non-sensible zone SG3 in the vicinity of the stoichiometric air-fuel ratio. Thus, the control becomes stabilized as if the gain of the controlled subject in the control system is lowered due to provision of the non-sensible zone. Accordingly, the air-fuel ratio is converged causing the exhaust gas to have a constant oxygen concentration. Thus, after a predetermined time (viz., after several seconds or so) from the electrode process of the oxygen sensor 3, the output voltage signal "Vs" of the sensor 3 shows a gentle characteristic as shown by the dot-dash curve "g1" of FIG. 2. As a result, the semi-linearized signal issued from the linearizer 4 shows a characteristic which, as is indicated by the curve "g2" of FIG. 2, has the non-sensible zone SG3 reduced in length, and finally shows a characteristic which, as is indicated by the curve "g5" of FIG. 5, has a characteristic curve generally linearized. That is to say, even when the air-fuel ratio control is carried out with a relatively high frequency, the output of the oxygen sensor 3 can be made static be effecting a feedback control, and thus the semi-linearized signal from the linearizer 4 is generally linearized having a small hysteresis. As a result, the PDI controller 5 can compute a practically injected fuel amount "Q" with a reduced control error.

Figure 5:
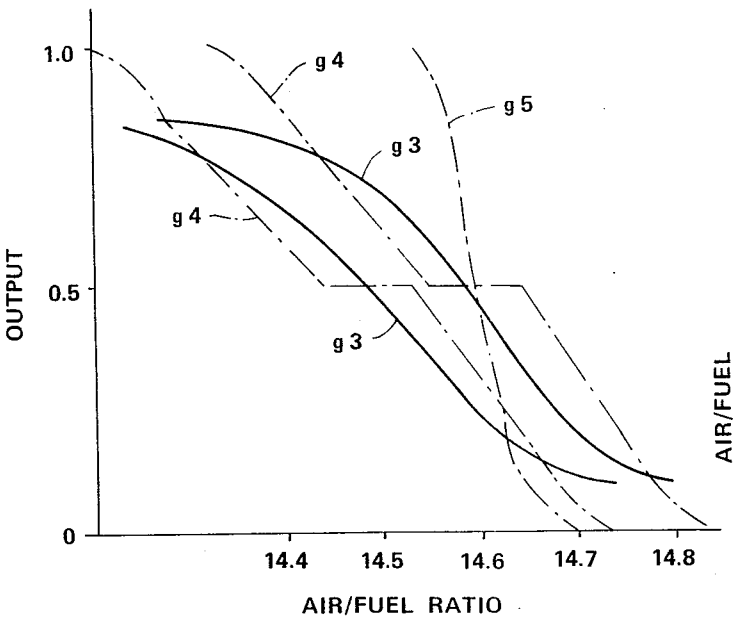
FIG. 5 is a graph showing the output signals issued from the oxygen sensor and the linearizer when the frequency of the control system is relatively high.

It is to be noted that the curves "g3" and "g4" in FIG. 5 show the respective characteristics of the output voltage signal "Vs" from the oxygen sensor 3 and the semi-linearized signal from the linearizer 4 under a condition wherein a four cylinder internal combustion engine runs at a speed of 1500 rpm changing the air-fuel ratio from 14.4 to 15.0 with a ratio changing frequency of 2.5 Hz.

In accordance with the first embodiment, the non-linear signal issued from the oxygen sensor 3 is generally linearized by the linearizer 4, and the PID controller 5 controls the amount of the practically injected fuel amount in accordance with the semi-linearized signal issued from the linearizer 4. That is, a feedback control is carried out in a manner to correct the amount of the injected fuel to a desired or target value. Accordingly, the air-fuel ratio of the combustible mixture is instantly brought o to the stoichiometric value, minimizing the control error. As a result, as is seen from the curve "g6" of FIG. 6A, the control error which would appear at a normal operation mode of the engine can be reduced to a value ranging from 0.2 to 0.3 in terms of air-fuel ratio. Thus, exhaust emission control is carried out effectively.

Figure 6A:
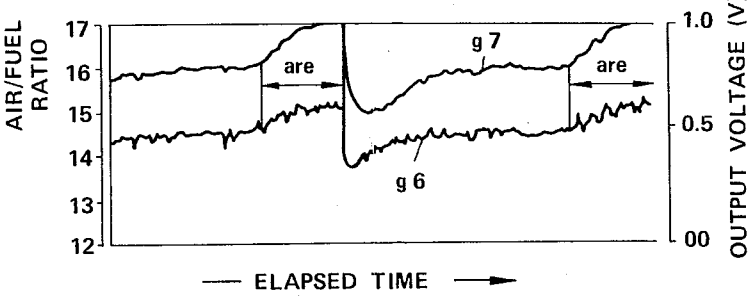
FIG. 6A is a graph showing respectively output signals issued from the oxygen sensor and the linearizer when the engine runs at a speed of 3000 rpm.
Figure 6B:
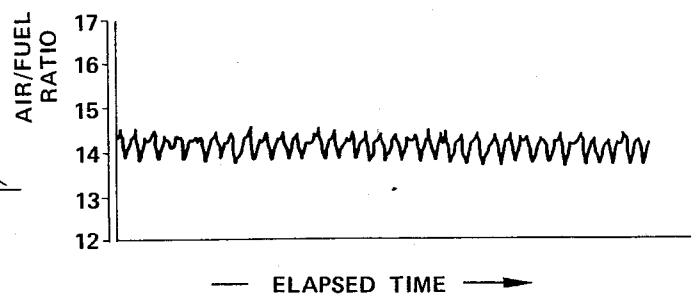
FIG. 6B is a graph showing the air-fuel ratio of a combustible mixture, which appears in a conventional air-fuel ratio control system.

The curve "g6" in FIG. 6A shows the air-fuel ratio of a combustible mixture practically fed to the engine under a condition wherein the engine runs at a speed of 3000 rpm with no load applied thereto. The curve "g7" shows the output voltage signal issued from the linearizer 4. As is seen from this graph, the wave forms of the air-fuel ratio of the combustible mixture and the output voltage signal from the linearizer 4 are very similar to each other. While, the curve shown in the graph in FIG. 6B shows the air-fuel ratio of a combustible mixture which is exhibited in a conventional air-fuel ratio control system under the same condition as that mentioned hereinabove. Comparing the graphs of FIGS. 6A and 6B, it become clear that the dispersion of the air-fuel ratio appearing in the first embodiment of the invention is small as compared with that of the conventional system. It is to be noted that the air-fuel ratio control depicted by the graph of FIG. 6B was carried out with a frequency of about 1 Hz, while, the control depicted by the graph of FIG. 6A was carried out with a higher frequency. Accordingly, in the invention, the capacity of the three-way catalytic converter may be reduced. It is further to be noted that the zone denoted by "are" in FIG. 6A show the waves produced when a disturbance is applied to the control system of the invention.

Figure 7:
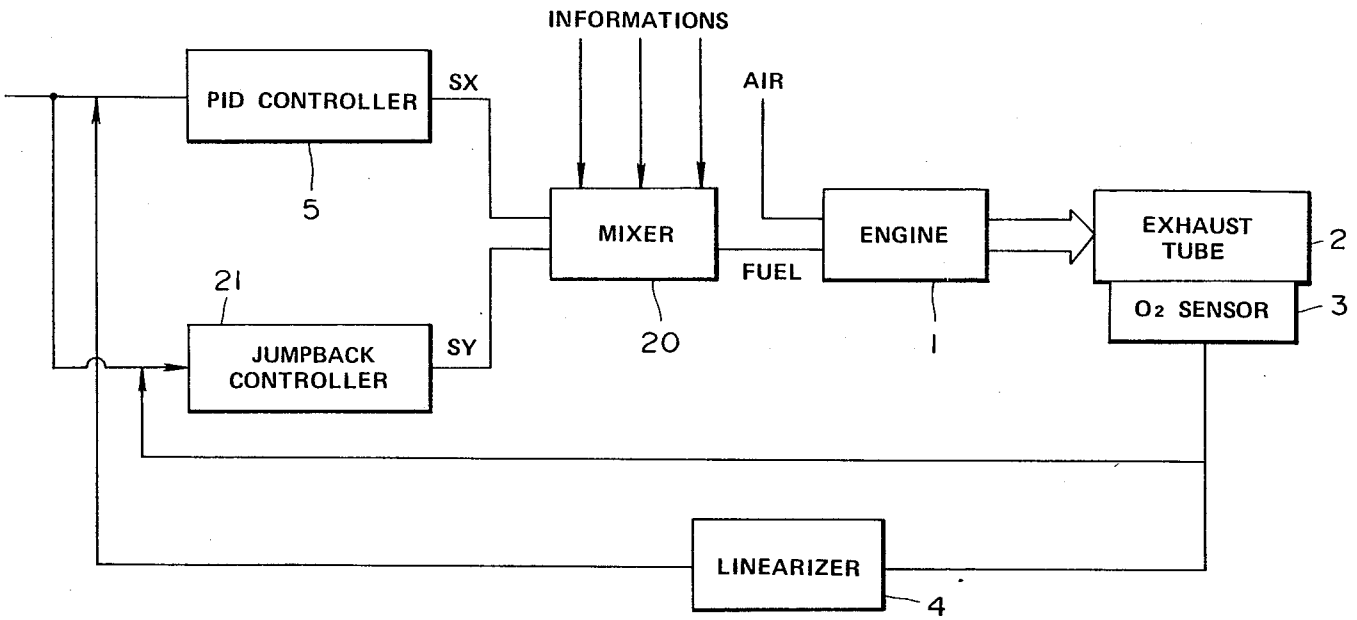
FIG. 7 is a block diagram of a control system of a second embodiment of the present invention.
Figure 8:
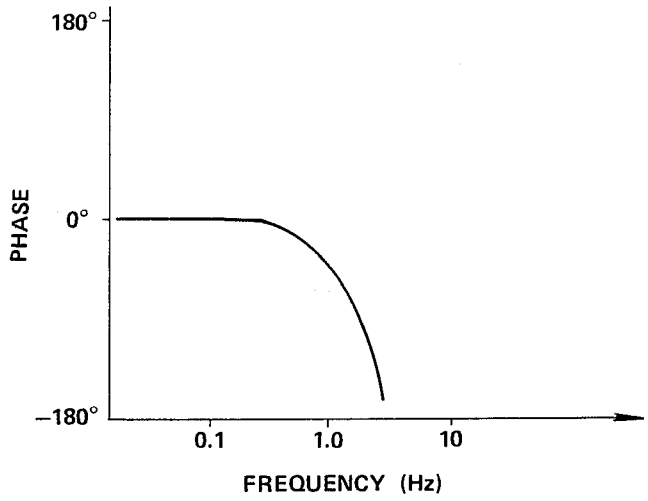
FIG. 8 is a graph showing a response delay appearing in an exhaust system.

In the following, a second embodiment of the present invention will be described with reference to FIG. 7.

Figure 9:
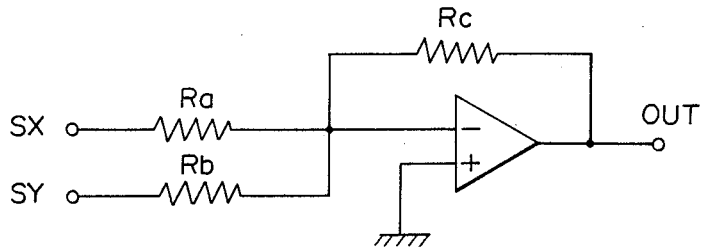
FIG. 9 is a circuit of a mixer employed in the second embodiment.

As is seen from the drawing, in the air-fuel ratio control system of the second embodiment, a mixer 20 is arranged between the PID controller 5 and the engine 1, and a known jump back controller 21 is further arranged. The mixer 20 is of an adding circuit which, as is illustrated in FIG. 9, comprises an operation amplifier and three fixed resistors Ra, Rb and Rc. The air-fuel ratio control signal issued from the jump back controller 21 is applied to the mixer 20.

In the system of the second embodiment, the amount "Q" of fuel practically fed to the engine is calculated from the following equation.

$$Q=(SX+t\cdot SY)/(1+t) \quad \ldots\ldots \quad (1)$$

wherein "SX" is a value of the signal issued from the PID controller 5, which is the same as that mentioned in the first embodiment, "SY" is a value of the signal issued from the jump back controller 21, which is the signal value appearing in a conventional control system, and "t" is a weight function of information signals representative of engine condition (such as engine speed, intake air amount, intake vacuum, throttle opening degree and the like) issued from various sensors.

In the second embodiment, the good transient responsibility is also achieved by the jump back controller 21. That is, the second embodiment has both the same advantage as that mentioned in the first embodiment and a good responsibility at the transient operation mode of the engine.

As will be clarified in the foregoing description, in the air-fuel ratio control system of the present invention, the control error of the air-fuel ratio at the normal operation mode of the engine is considerably reduced as compared with that of the afore-mentioned conventional control system.

What is claimed is:

1. A system for controlling air-fuel ratio of a combustion mixture fed to an internal combustion engine, comprising:

an oxygen sensor disposed in an exhaust system of the engine, said oxygen sensor exhibiting a sudden characteristic change when exposed to an exhaust gas produced by a combustible mixture of stoichiometric air-fuel ratio, said oxygen sensor issuing a first signal representative of the oxygen concentration in the exhaust gas;

first means for linearizing said first signal to produce a semi-linearized signal which has a non-sensible zone at a portion which corresponds to the portion of said first signal at which said sudden characteristic change appears; and second means for controlling the amount of fuel fed to the engine in accordance with said semi-linearized signal.

2. A system as claimed in claim 1, in which said first means linearizes the signal from said oxygen sensor in a manner to allow said semi-linearized signal to have a non-sensible zone of a given length under a predetermined condition of the engine.

3. A system as claimed in claim 2, in which said first means linearizes the signal from said oxygen sensor in such a manner that said semi-linearized signal has a non-sensible zone of a given length when the signal from said oxygen sensor represents that the air-fuel ratio of the combustible mixture is in the vicinity of a predetermined value.

4. A system as claimed in claim 2, in which said first means linearizes the signal from said oxygen sensor in such a manner that said semi-linearized signal has a non-sensible zone of a given length when said oxygen sensor issues a predetermined output.

5. A system for controlling air-fuel ratio of a combustion mixture fed to an internal combustion engine, comprising:

an oxygen sensor disposed in an exhaust system of the engine, said oxygen sensor exhibiting a sudden characteristic change when exposed to an exhaust gas produced by a combustible mixture of stoichiometric air-fuel ratio, said oxygen sensor issuing a signal representative of the oxygen concentration in the exhaust gas;

first means for linearizing said signal to produce a semi-linearized signal, said first means linearizing the signal from said oxygen sensor in such a manner that said semi-linearized signal has a non-sensible zone of a given length when the signal from said oxygen sensor represents that the air-fuel ratio of the combustible mixture is in the vicinity of a predetermined value, said first means comprising:

a rich signal linearizing circuit which, by comparing a rich voltage signal higher than 0.5 V with a predetermined reference value, increases or reduces the rich voltage signal to produce a first linear signal;

a lean signal linearizing circuit which, by comparing a lean voltage signal lower than 0.5 V with a predetermined reference value, increases or decreases the lean voltage signal to produce a second linear signal;

a filter buffer circuit;

a first comparator functioning so that when the first linear signal is not lower than 0.5 V, a first analog switch becomes ON thereby to feed said filter buffer circuit with said first linear signal;

a second comparator functioning so that when the second linear signal is lower than 0.5 V, a second analog switch becomes ON thereby to feed the filter buffer circuit with said second linear signal; and a NOR circuit which receives the output signals issued from said first and second comparators, said NOR circuit functioning so that when the first linear signal is lower than 0.5 V and the second linear signal is not lower than 0.5 V, a third analog switch becomes ON thereby to feed said filter buffer circuit with a predetermined value of 0.5 V; and means for controlling the amount of fuel fed to the engine in accordance with said semi-linearized signal.

6. A system as claimed in claim 5, in which said first means comprises operational amplifiers, fixed resistors, variable resistors, analog switches and an electrolytic capacitor.

7. A system as claimed in claim 5, in which said second means comprises a PID controller.

8. A system as claimed in claim 7, in which said second means further comprises a jump back controller.

9. A system for controlling air-fuel ratio of a combustion mixture fed to an internal combustion engine, comprising:

an oxygen sensor disposed in an exhaust system of the engine, said oxygen sensor exhibiting a sudden characteristic change when exposed to an exhaust gas produced by a combustible mixture of stoichiometric air-fuel ratio, said oxygen sensor issuing a signal representative of the oxygen concentration in the exhaust gas;

first means for linearizing said signal to produce a semi-linearized signal, said first means, said first means linearizing the signal from said oxygen sensor in such a manner that said semi-linearized signal has a non-sensible zone of a given length when said oxygen sensor issues a predetermined input, said first means comprising:

a rich signal linearizing circuit which, by comparing a rich voltage signal higher than 0.5 V with a predetermined reference value, increases or reduces the rich voltage signal to produce a first linear signal;

a lean signal linearizing circuit which, by comparing a lean voltage signal lower than 0.5 V with a predetermined reference value, increase or decreases the lean voltage signal to produce a second linear signal;

a filter buffer circuit;

a first comparator functioning so that when the first linear signal is not lower than 0.5 V, a first analog switch becomes ON thereby to feed said filter buffer circuit with said first linear signal;

a second comparator functioning so that when the second linear signal is lower than 0.5 V, a second analog switch becomes ON thereby to feed the filter buffer circuit with said second linear signal; and a NOR circuit which receives the output signals issued from said first and second comparators, said NOR circuit functioning so that when the first linear signal is lower than 0.5 V and the second linear signal is not lower than 0.5 V, a third analog switch becomes ON thereby to feed said filter buffer circuit with a predetermined value of 0.5 V; and second means for controlling the amount of fuel fed to the engine in accordance with said semi-linearized signal.

* * * * *

UNITED STATES PATENT AND TRADEMARK OFFICE

CERTIFICATE OF CORRECTION

PATENT NO. :4,917,067

DATED :April 17, 1990

INVENTOR(S) :Hideji Yoshida

It is certified that error appears in the above-identified patent and that said Letters Patent is hereby corrected as shown below:

The Title page, showing an illustrative figure, should be deleted and substitute therefor the attached Title page.

Signed and Sealed this

First Day of November, 1994

*Attest:*

*Attesting Officer*

Bruce Lehman

BRUCE LEHMAN

*Commissioner of Patents and Trademarks*

United States Patent [19]

Yoshida

[11] Patent Number: 4,917,067

[45] Date of Patent: Apr. 17, 1990

[54] SYSTEM FOR CONTROLLING AIR-FUEL RATIO OF COMBUSTIBLE MIXTURE FED TO INTERNAL COMBUSTION ENGINE

[75] Inventor: Hideji Yoshida, Hashima, Japan

[73] Assignee: NGK Spark Plug Co., Ltd., Nagoya, Japan

[21] Appl. No.: 229,466

[22] Filed: Aug. 8, 1988

[30] Foreign Application Priority Data

Nov. 5, 1987 [JP] Japan ..... 62-279853

[51] Int. Cl.[4] ..... F02D 41/14

[52] U.S. Cl. ..... 123/488; 123/489

[58] Field of Search ..... 123/440, 488, 489, 494

[56] References Cited

U.S. PATENT DOCUMENTS

| | | | |
|---|---|---|---|
| 4,019,474 | 4/1977 | Nishimiya et al. | 123/440 |
| 4,116,170 | 9/1978 | Anzai | 123/440 |
| 4,337,745 | 7/1982 | Pomerantz | 123/440 |

FOREIGN PATENT DOCUMENTS 61-10762 1/1986 Japan .

*Primary Examiner*—Tony M. Argenbright

*Attorney, Agent, or Firm*—Foley & Lardner, Schwartz, Jeffery, Schwaab, Mack, Blumenthal & Evans

[57] ABSTRACT

There is disclosed a system for controlling air-fuel ratio of a combustion mixture fed to an internal combustion engine. The system comprises an oxygen sensor disposed in an exhaust system of the engine, the oxygen sensor exhibiting a sudden characteristic change when exposed to an exhaust gas produced by a combustible mixture of stoichiometic air-fuel ratio, the oxygen sensor issuing a signal representative of the oxygen concentration in the exhaust gas; first means for substantially linearizing the signal to produce a semi-linearized signal; and second means for controlling the amount of fuel fed to the engine in accordance with the semi-linearized signal.

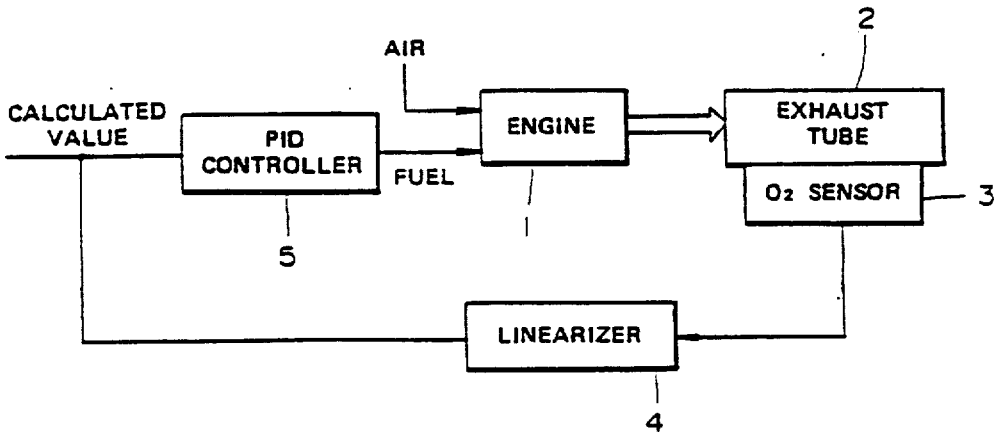

9 Claims, 6 Drawing Sheets